US007115828B2

(12) United States Patent
McCord et al.

(10) Patent No.: US 7,115,828 B2
(45) Date of Patent: Oct. 3, 2006

(54) INTERNALLY SWITCHED ELECTRIC POWER INTERRUPTER

(75) Inventors: Neil McCord, Fayetteville, GA (US); Joseph R. Rostron, McDonough, GA (US); John M. Wolka, Fayetteville, GA (US)

(73) Assignee: Southern States, Inc., Hampton, GA (US)

( * ) Notice: Subject to any disclaimer, the term of this patent is extended or adjusted under 35 U.S.C. 154(b) by 251 days.

(21) Appl. No.: 10/836,181

(22) Filed: Apr. 30, 2004

(65) Prior Publication Data

US 2005/0241928 A1 Nov. 3, 2005

(51) Int. Cl.
*H01H 5/00* (2006.01)

(52) U.S. Cl. ..... 200/400; 218/154

(58) Field of Classification Search ..... 200/400, 200/401, 500, 501, 318–325; 218/7, 14, 218/78, 84, 92, 120, 140, 153, 154; 335/171
See application file for complete search history.

(56) References Cited

U.S. PATENT DOCUMENTS 4,636,602 A * 1/1987 Hall et al. ..... 200/400
4,841,788 A * 6/1989 Thuries et al. ..... 200/400
5,508,487 A * 4/1996 Smith et al. ..... 218/154
6,657,150 B1 * 12/2003 Shea et al. ..... 218/154
6,696,658 B1 * 2/2004 Kowalyshen et al. ..... 218/154
6,831,244 B1 * 12/2004 Kawamoto et al. ..... 218/78
6,917,006 B1 * 7/2005 Bachofen ..... 200/400

* cited by examiner

*Primary Examiner*—Michael A. Friedhofer
(74) *Attorney, Agent, or Firm*—Michael J. Mehrman; Mehrman Law Offices PC

(57) ABSTRACT

An electric power interrupter with an internal contactor that is suitable for use as a line and load switch constructed from light weight materials including a fiberglass or composite insulator and aluminum flanges. The light weight design feature allows the power interrupter to be supported above a standard disconnect switch insulator without having to replace or reinforce the insulator. The power interrupter also includes a latch mechanism with a low-force trip action, such as a spring-driven toggle mechanism that accelerates the internal contactor to break the electric power circuit on the opening stroke. This low-force trip action allows the power interrupter to be actuated by a standard disconnect switch operating mechanism without having to upgrade or augment the standard operating mechanism. For these reasons, the power interrupter may be installed as a retrofit upgrade to an existing standard disconnect switch without having to modify the underlying disconnect switch.

28 Claims, 9 Drawing Sheets

INTERNALLY SWITCHED ELECTRIC POWER INTERRUPTER

REFERENCE TO RELATED APPLICATIONS

The present application incorporates by reference the disclosures of the following commonly-owned U.S. Pat. Nos. 6,583,978; 6,483,679; 6,316,742; and 6,236,010.

TECHNICAL FIELD

The present invention relates to electric switchgear and, more particularly, relates to an electric power switch that internally breaks the electric power circuit on the opening stroke, and which is suitable for use as a line and load switch at distribution, sub-transmission and transmission voltages.

BACKGROUND OF THE INVENTION

Circuit breakers, line switches, disconnect switches and capacitor switches are well known components of electric transmission and distribution systems. Within these devices, spring-driven acceleration mechanisms have been used to accelerate penetrating contactors to sufficient velocity to extinguish an arcing contact occurring across a contactor gap within the switch without experiencing an undesirable restrike, which could otherwise cause disturbances on the electric power system. This typically requires extinguishing the arc after one-half cycle, which prevents a restrike from occurring after the initial arc break that occurs at the first half-cycle zero voltage crossing after initial separation of the contacts. For this type of device, it is helpful to house the penetrating contactor within a sealed container filled with a dielectric gas such as sulphur hexafluoride ($SF_6$), which is directed into the contactor gap by a nozzle to help extinguish the arc. Extinguishing the arc in this manner, which is specifically designed to effectively absorb the arc energy, reduces the contactor gap separation required to extinguish the arc from what would be required to extinguish the arc in another environment such as air.

The basic design challenge for this type of device involves engineering an acceleration mechanism that obtains the desired contractor velocity quickly enough to extinguish the arc without experiencing an undesired restrike within acceptable weight, size and cost constraints. An example of this type of device employing a bidirectional spring-driven toggle mechanism is shown in Rostron et al., U.S. Pat. No. 6,583,978 entitled "Limited Restrike Electric Power Circuit Interrupter Suitable For Use as a Line Capacitor and Load Switch," which is incorporated herein by reference. Other types of spring-driven acceleration mechanism have been used to accelerate penetrating contactors for many years. For example, see U.S. Pat. Nos. 6,483,679; 6,316,742; and 6,236,010, which are also incorporated herein by reference. In general, spring-driven acceleration and toggle mechanisms for accelerating penetrating contactors for single- and three-phase electric power switch configurations are well known.

Although the power interrupter employing a bidirectional spring-driven toggle mechanism shown in Rostron et al. is an effective and commercially successful device, it has the drawback of requiring a relatively large enclosure to house relatively robust internal components of the device. The weight of this type of power interrupter requires that the insulator supporting the stationary contact of the underlying disconnect switch, on top of which the power interrupter is mounted, be upgraded to carry the additional weight of the power interrupter. In addition, the additional force required to move the actuator arm of the power interrupter, and thereby charge the main spring of the device, with the moving arm of the disconnect switch also typically requires an upgrade to the disconnect switch operating mechanism. As a result, this type of power interrupter is only suitable for new installations and those justifying an upgrade to the disconnect switch insulator and operating mechanism.

Moreover, in many electric power applications, such as standard line and load switch applications, internal switching is very important when opening the switch but of less importance when closing or resetting the switch. Therefore, a bidirectional toggle mechanism may not be necessary, whereas a single break device that internally breaks the power circuit only on the opening stroke may be better suited for these applications. In particular, a bidirectional toggle switch requiring an upgrade to the underlying disconnect switch might be too expensive in many instances in which a single break device installed as a retrofit without having to alter the existing disconnect switch might be a cost effective option. As a result, the ability to install the power interrupter as a retrofit without having to alter the existing disconnect switch would make the device a cost effective option for a large number of disconnect switches operating at distribution, sub-transmission and transmission voltages.

Accordingly, there is an ongoing need for cost effective electric power interrupters suitable for use as line and load switches at distribution, sub-transmission and transmission voltages. There is a further need for a power interrupter that can be installed as a retrofit without having to alter the existing disconnect switch.

SUMMARY OF THE INVENTION

The present invention meets the needs described above in an single break electric power interrupter that internally extinguishes the arc to break the electric power circuit only on the opening stroke. The interrupter is has simple, rugged, small, light, and low-cost design with a low-force trip action. These weight and operating characteristics allow the power interrupter to be installed as a retrofit to an existing disconnect switch without having to alter the supporting insulator or operating mechanism of the underlying disconnect switch. As a result, the power interrupter is a cost effective option for a large number of disconnect switches operating at distribution, sub-transmission and transmission voltages.

One of the operational features of the power interrupter producing these advantageous characteristics is a latch mechanism that may be maneuvered into a cocked position in which the main spring of the interrupter is maintained in a charged condition. The latch mechanism is then released from the cocked position in response to a low-force trip action to release the movable contact of the interrupter to accelerate under the force of the main spring during the opening stroke of the underlying disconnect switch. Several alternative embodiments of the latch mechanism have been developed, including a toggle mechanism, a slot link and pawl mechanism, and an cam and pawl mechanism. Each of these designs is simple, rugged, small, light, and low-cost, which renders them suitable for the present power interrupter. Other design alternatives for the latch mechanism and other features of the power interrupter will become apparent to those skilled in the art once the fundamental elements of the invention are understood.

Generally described, the invention may be described as an internally switched electric power interrupter including an insulator having an internal chamber. A contactor having a movable contact and a stationary contact operable for opening an electric power circuit is located within the internal chamber. The power interrupter also includes a main spring operable for linearly accelerating the movable contact sufficiently to extinguish an arc occurring across a gap between the movable contact and the stationary contact at a designed operational voltage of the electric power circuit. A latch mechanism may be maneuvered into a cocked position in which the main spring is maintained in a charged condition. The latch mechanism may then be released from the cocked position in response to a trip action to release the movable contact of the power interrupter to accelerate under the force of the main spring to open the electrical circuit.

In one embodiment, the latch mechanism of the power interrupter includes a toggle mechanism. This toggle mechanism may include a linkage arm that is pivotally connected to a drive shaft, which is in turn in physical communication with the movable contact of the power interrupter. The toggle mechanism may also include a push link pivotally connected to the drive shaft proximate to a first end of the push link. The push link typically includes a first guide element proximate to a second end of the push link. The toggle mechanism may also include a trip link pivotally connected to the linkage arm proximate to a first end of the trip link. The trip link typically includes a trip element proximate to a second end of the trip link. The toggle mechanism may also include a main link pivotally connected to the trip link. The trip link typically includes a second guide element at a first end of the main link and a trip lever proximate to a second end of the main link. The toggle mechanism may also include a stop configured to maintain the toggle mechanism in the cocked position. The main link is typically configured to rotate under applied force to create the trip action by pushing the trip element to release the toggle mechanism from the cocked position and thereby release the drive shaft to linearly accelerate the movable contact of the power interrupter under force applied by the main spring.

More specifically, the first guide element may include a guide surface such as slot. The second guide element may include another guide surface, such as a pin captured within the slot. For example, the pin may be sliding pin that slides within the slot or it may be a roller pin that rolls within the slot. Other types of guides may be used, such as a scissors mechanism, a folding arm mechanism, or a cam and cam follower mechanism. In addition, the trip element may be a push surface, such as a pin or cam surface, and the main link be a lever, cam or other suitable mechanism. The stop may be a stop surface, such as a pin or wall, which may be attached to the toggle mechanism or to a structure supporting the toggle mechanism. Alternatively, the stop may be some other type of suitable detent mechanism, such as a stable position of the toggle mechanism that imparts the latching function desired to maintain the main spring in a charged condition prior to the trip action.

In this toggle mechanism, the linkage arm typically rests against the stop when the toggle mechanism is in the cocked position. In addition, the linkage arm and the trip link are typically maintained in an almost linear configuration when the toggle mechanism is in the cocked position resulting in a low-force trip action. The pin typically moves within the slot as the drive shaft moves under the force of the main spring. The toggle mechanism is typically housed within an enclosure adjacent to an end of the internal chamber of the insulator, the internal chamber typically contains a dielectric gas, and the drive shaft typically extends from the enclosure through a seal proximate to the end of the internal chamber and into the internal chamber.

In other embodiments, the latch mechanism may include a slot link and pawl device or a cam and pawl device. Other design options include a drive shaft having a low friction outer surface, such as a baked-on solid film lubricant, a secondary spring such as one or more spring washers to assist the main spring during an initial portion of the movement of the drive shaft after the release of the toggle mechanism, and a tulip-type probe-and-socket contactor. In addition, the seal may be a linear shaft seal, a bellows, or a bellows seal containing a secondary spring to assist in acceleration of the movable contactor.

The trip action to activate the power interrupter is typically applied to the latch mechanism through movement of an actuator arm that pivotally drives the main link. Specifically, a moving disconnect arm of a disconnect switch applies the trip action to the actuator arm by moving the actuator arm from an initial position during an initial, portion of an opening stroke of the disconnect arm, thereby triggering the internally switched electric power interrupter to break the electric power circuit across the contactor within the internal chamber of the interrupter to avoid multiple arcing restrikes across a gap between the moving disconnect arm and an associated stationary disconnect contact during the opening stroke of the disconnect arm. The actuator may be returned to its initial position, thereby returning the latch mechanism to the cocked position, by gravity, the disconnect arm, or a return spring.

For retrofit applications, the disconnect arm, the stationary disconnect contact, and the insulator supporting the stationary disconnect contact may be standard disconnect switch elements that need not be modified to accommodate the installation of the internally switched electric power interrupter. Accordingly, the invention may also be practiced by installing an internally switched electric power interrupter to operate cooperatively with an existing standard disconnect switch, preferably without modifying the disconnect arm, the stationary disconnect contact, or the insulator supporting the stationary disconnect contact of the disconnect switch.

The specific techniques and structures for implementing particular embodiments of the internally switched electric power interrupter, and thereby accomplishing the advantages described above, will become apparent from the following detailed description of the embodiments and the appended drawings and claims.

DETAILED DESCRIPTION OF THE EMBODIMENTS

Figures 1, 2, 3:
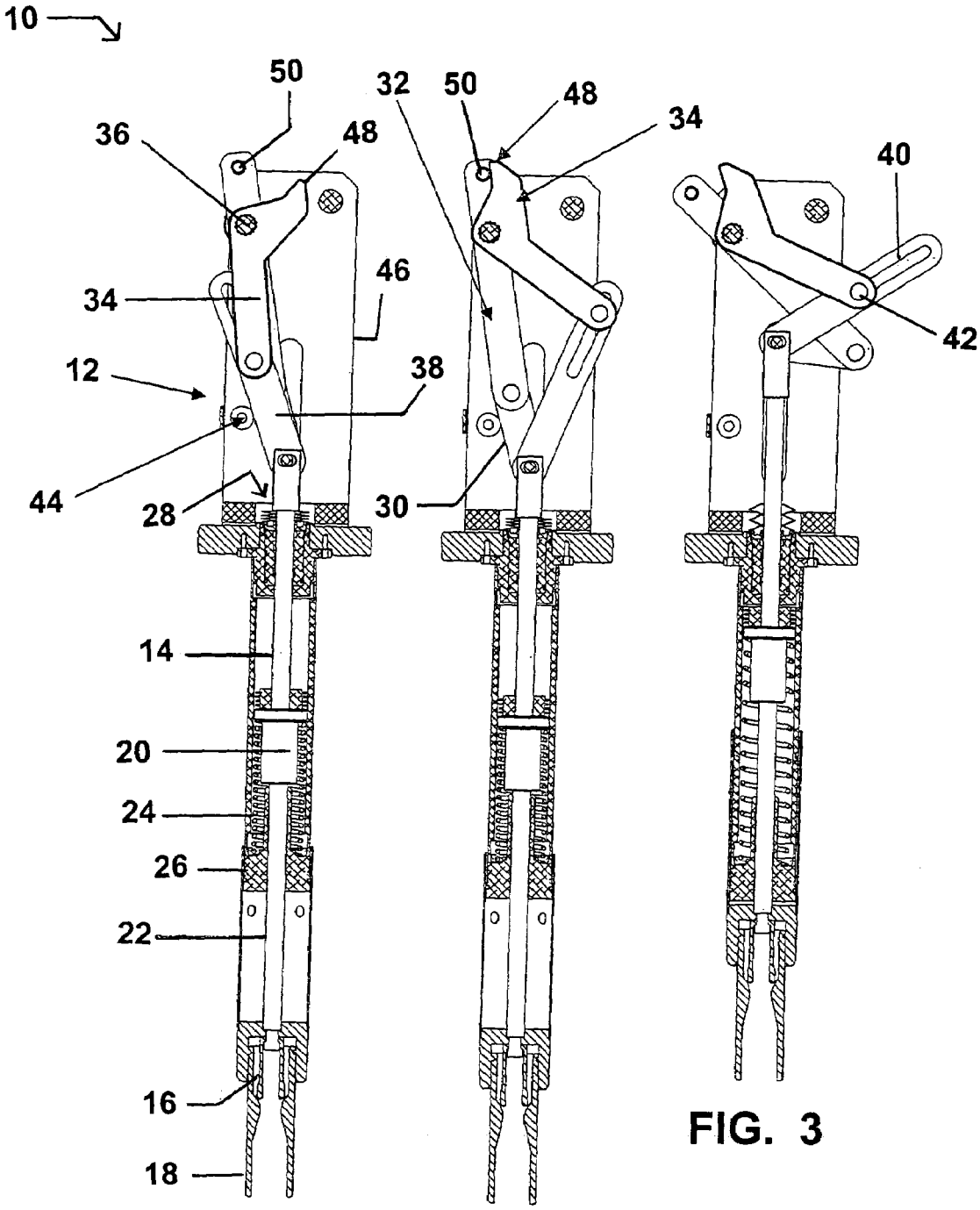
FIG. 1 is a side cross-sectional view of a portion of an internally switched electric power interrupter including a toggle mechanism in the closed position.
FIG. 2 is a side cross-sectional view of the power interrupter of FIG. 1 just prior to the beginning of the opening stroke.
FIG. 3 is a side cross-sectional view of the power interrupter of FIG. 1 at the end of the opening stroke.

The present invention may be embodied in an electric power interrupter with an internal contactor that is suitable for use as a line and load switch at distribution, sub-transmission and transmission voltages. Power interrupters have been constructed using the techniques described herein for operating voltages up to 245 kV. The power interrupter may be constructed from light weight materials including a fiberglass or composite insulator and aluminum flanges. The light weight design feature allows the power interrupter to be supported above a standard disconnect switch insulator without having to replace or reinforce the insulator. The power interrupter also includes a latch mechanism with a low-force trip action, such as a spring-driven toggle mechanism that accelerates the internal contactor to break the electric power circuit on the opening stroke. This low-force trip action allows the power interrupter to be actuated by a standard disconnect switch operating mechanism without having to upgrade or augment the existing operating mechanism. For these reasons, the power interrupter may be installed as a retrofit upgrade to an existing standard disconnect switch without having to modify the underlying disconnect switch.

The power interrupter may be deployed in a number of embodiments, and a range of suitable options may be selected for the various components. For example, the hollow-core insulator housing the internal contactor may be constructed from fiberglass or any other light weight material suitable for this application, such as many plastic and composite materials. The support flanges are preferably aluminum due to the light weight and low cost of this material, but other sufficiently strong and light weight materials may be used. The weather cover housing the latch mechanism and internal support plate may also be constructed from a range of suitable materials.

The internal contactor is preferably a tulip-type socket-and-probe penetrating contactor, such as the contactor shown in U.S. Pat. No. 6,236,010. However, other types of penetrating contactors may be employed, and non-penetrating contactors such as butt contactors may be employed if desired. The internal chamber of the insulator housing the contactor is preferably filled with a dielectric gas, such as $SF_6$, but other types of dielectric gas (or ambient air if desired) could be used. Nevertheless, a tulip-type socket-and-probe penetrating operating in an environment of $SF_6$ gas is presently believed to be the most cost effective configuration for the desired weight, size and operating force design constraints.

The latch mechanism could be deployed in a number of different configurations. In particular, a toggle mechanism, a slot link and pawl mechanism, and a cam and pawl mechanism are disclosed in detail. Other suitable types of latch mechanisms, such as a ratchet and pawl mechanism, will become apparent to those skilled in the art. Each mechanism may be altered somewhat while still operating in the intended manner. With respect to the toggle mechanism, for example, several different types of guide elements may be used, such as a slot and pin mechanism, a piston and cylinder mechanism, a scissors mechanism, a folding arm mechanism, a cam and cam follower mechanism, and so forth. Similarly, the toggle mechanism includes a stop that may be embodied as a pin, wall or shelf that may be connected to an element of the toggle mechanism or the supporting structure. Alternatively, the stop may be some other type of suitable detent mechanism, such as a stable condition of the linkage elements that provides the latching function desired to maintain the main spring in a charged condition prior to the trip action.

The power interrupter may also employ a number of different reset mechanisms to return the latch mechanism to the cocked position after an opening stroke. For example, the latch mechanism is typically tripped during an initial portion of the opening stroke of the moving arm of the disconnect switch, which rotates an actuator of the power interrupter. After the actuator arm has been moved sufficiently to trip the latch mechanism, the disconnect arm releases the actuator arm as shown, for example, in U.S. Pat. No. 6,583,978. The actuator arm may then be returned to its original position to reset the latch mechanism by gravity, by a return spring, or by the moving arm of the disconnect switch during its closing stroke. Other resetting techniques may become apparent to those skilled in the art.

The power interrupter may also employ a number of other optional features that improve the operating, size, weight and/or cost characteristics of the device. For example, the shaft driving the moving contact of the internal contactor may be coated with a lubricant, such as a baked on solid film lubricant. The seal between the drive shaft and the insulator may be a linear shaft seal or a bellows seal. In addition, a secondary spring may assist the main spring. For example, the secondary spring may one or more spring washers or a coil spring formed into the bellows seal. Again, additional optional features that may improve the operating, size, weight and/or cost characteristics of the device may become apparent to those skilled in the art.

Turning now to the drawings, in which like numerals refer to like elements throughout the several figures, FIG. 1 is a side cross-sectional view of the upper portion of an internally switched electric power interrupter 10 including a toggle mechanism 12 in the closed position. The toggle mechanism linearly drives a shaft 14 that is in physical communication with the moving contact 16 of a tulip-type penetrating contactor that is housed within an insulator 70 (shown in FIG. 7). A nozzle 18 surrounds the moving contact 16 and directs a dielectric gas ($SF_6$) contained within the internal chamber of the insulator into the gap between the moving contact and a stationary contact of the internal contactor during the opening stroke of the power interrupter 10, as is well known in the art (see, for example, U.S. Pat. No. 6,583,978). The drive shaft 14 is connected to the moving contact 16 by way of a plunger 20 and a connecting rod 22. The moving contact 16 is accelerated during the opening stroke of the power interrupter 10 by a main spring 24, which bears on the plunger 20 and a support wall 26 ion the interior surface of the insulator 70 or an associated support tube forming the internal chamber of the insulator.

The toggle mechanism 12 is a type of latch mechanism that maintains the power interrupter 10 in a cocked position with the main spring charged, as shown in FIG. 1, prior to receiving a trip action that releases the latch mechanism top allow the main spring to accelerate the moving contact 16, as shown in the transition from FIG. 1 (power interrupter closed) through FIG. 2 (power interrupter just prior to trip action) to FIG. 3. (power interrupter open). The toggle mechanism 12 is typically located outside the internal chamber of the insulator 70, which is filled with the dielectric gas ($SF_6$). To keep the gas from escaping, the drive shaft 14 passes through a seal 28, which may be a linear shaft seal or a bellows seal. When a linear shaft seal is employed, one or more secondary springs, such as spring washers (also known as Bellville washers), may be employed to assist the main spring during the initial movement of the drive shaft 14 on the opening stroke. When a bellows seal is used, as shown in FIGS. 1–3, the secondary spring may be a coil spring formed into the bellows seal.

The toggle mechanism 12 includes a linkage arm 30 (shown best in FIG. 2) that is pivotally connected to the drive shaft 14. The linkage arm 30 is also pivotally connected to a trip link 32 (shown best in FIG. 2), which is pivotally connected to a main link 34. The main link, in turn, is rotated by a shaft 36, which is driven by an actuator arm 72 (shown in FIG. 7) to operate the toggle mechanism 12. The drive shaft 14 is also pivotally connected to a push link 38, which includes a first guide element, in this embodiment a slot 40 (shown best in FIG. 4). The main link 34 includes a second guide element, in this embodiment a pin 42 (shown best in FIG. 4) that is captured within the slot 40. The pin 42 be a sliding pin or a roller pin that travels within the slot 40 as the toggle mechanism 12 moves to accelerate the drive shaft 14.

When the toggle mechanism 12 is in the cocked position with the main spring 24 maintained in a charged condition, as shown in FIG. 1, the linkage arm 30 rests against a stop 44, in this embodiment a pin mounted on a support plate 46, which supports the toggle mechanism 12. In this cocked position, the linkage arm 30 and the trip link 32 are stable in a nearly linear configuration, which allows a toggle-over motion to be initiated with a low-force trip action. This trip action is imparted by a trip lever 48 located at the end of the main link 34 that pushes against a trip element, in this embodiment a trip pin 50 located near the end of the trip link 32. FIG. 1 shows the power interrupter 10 in the cocked position prior to movement of the actuator arm 72. FIG. 2 shows the power interrupter 10 after an initial movement of the actuator arm 72 and just prior to the trip action. That is, the trip lever 48 is touching the trip pin 50 such that a small additional rotation of the main link 34 (caused by a small additional movement of the actuator arm 72) will cause the toggle mechanism 12 to toggle over to the position shown in FIG. 3.

The trip action is caused by rotating the actuator arm 72, which is typically pushed by the moving arm of the underlying disconnect switch during an initial portion of the opening stroke of the moving arm of the disconnect switch. The movement of the disconnect arm and the actuator arm 72 is coordinated such that the electric power circuit is broken at an arc extinguished at the gap of the internal contactor of the power interrupter 10 without multiple arcing restrikes occurring across the disconnect switch, which could otherwise cause undesirable disturbances on the power system. After triggering the power interrupter 10 on the opening stroke, the disconnect arm typically releases the actuator arm 72 and continues to its fully open (typically vertical) position.

Figure 4:
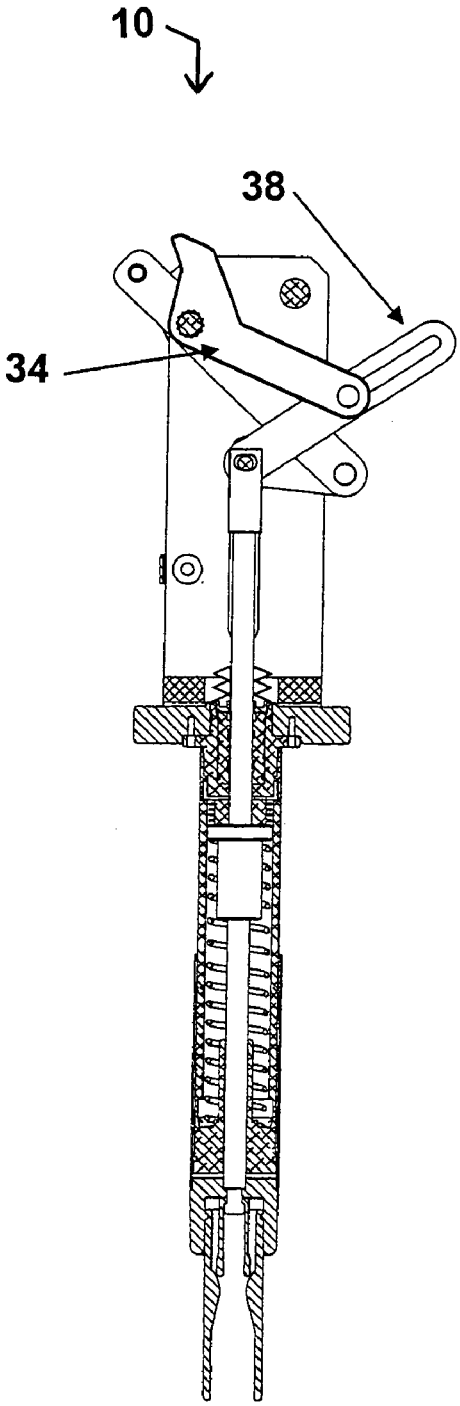
FIG. 4 is a side cross-sectional view of the power interrupter of FIG. 1 at the beginning of the closing stroke.
Figure 5:
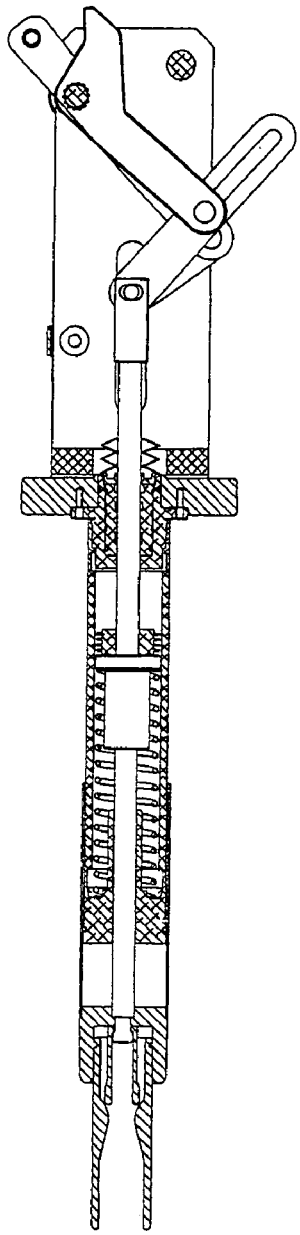
FIG. 5 is a side cross-sectional view of the power interrupter of FIG. 1 after an initial portion of the closing stroke.
Figure 6:
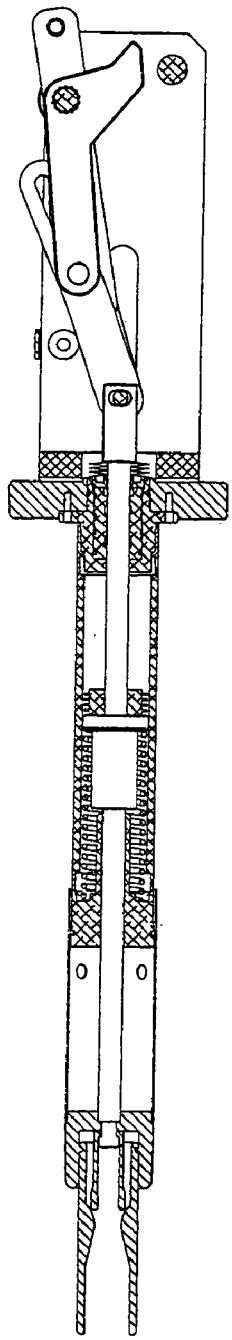
FIG. 6 is a side cross-sectional view of the power interrupter of FIG. 1 at the end of the closing stroke.

The transitions from FIG. 4 (open) through FIG. 5 (partially closed) to FIG. 6 (fully closed) illustrate the closing stroke of the power interrupter 10. This closing stroke is caused by returning the actuator arm 72 to its initial position, which returns the toggle mechanism 12 to the cocked position. The actuator may be returned to its initial position by gravity or by a return spring, Alternatively, the actuator arm 72 may be returned to its initial position by the disconnect arm as it returns to its closed position during its closing stroke, as shown in U.S. Pat. No. 6,583,978.

Figure 7:
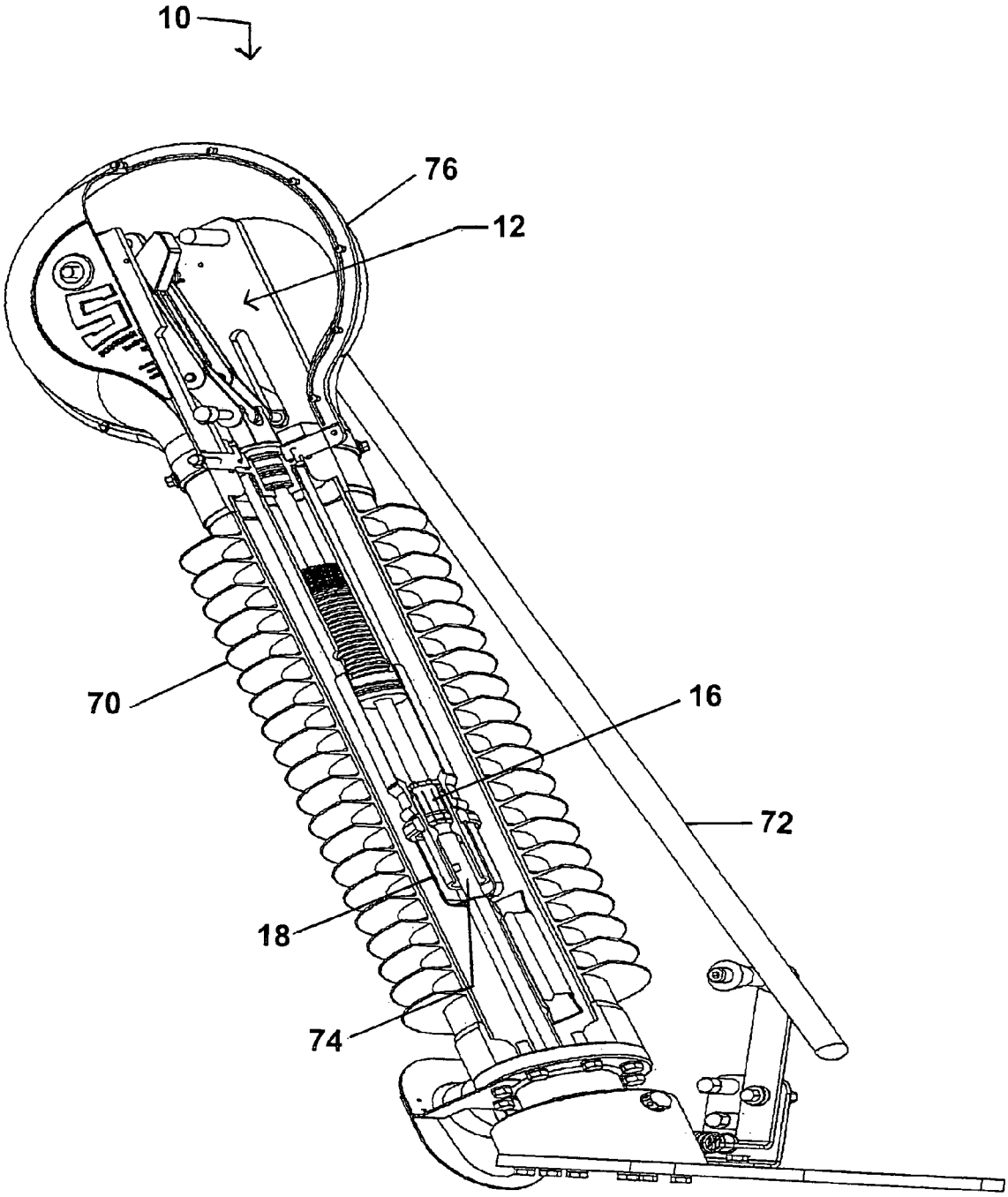
FIG. 7 is a perspective cut-away view of an internally switched electric power interrupter including a toggle mechanism.
Figure 8:
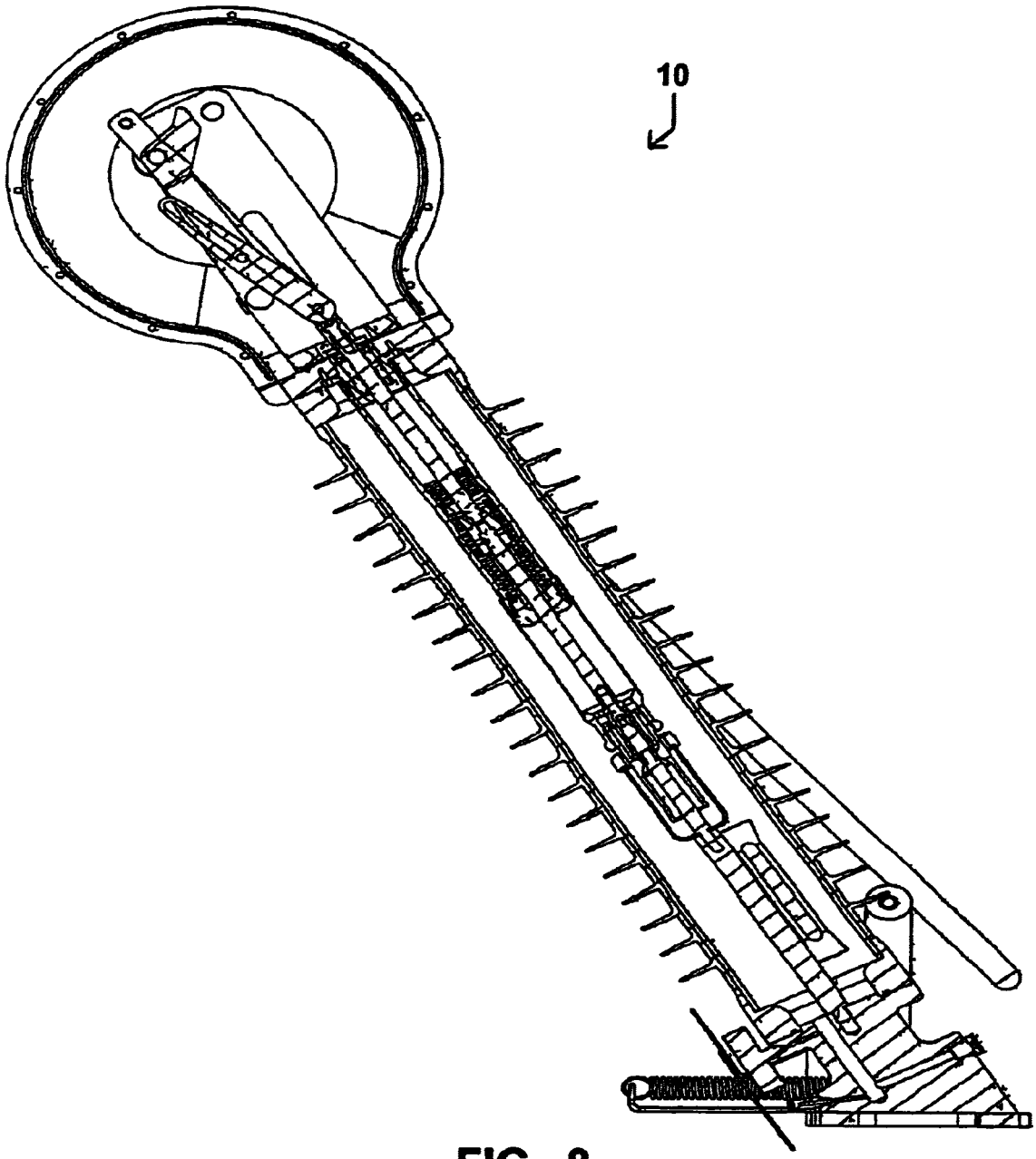
FIG. 8 is a cross-sectional side view of the internally, switched electric power interrupter of FIG. 7.
Figure 9:
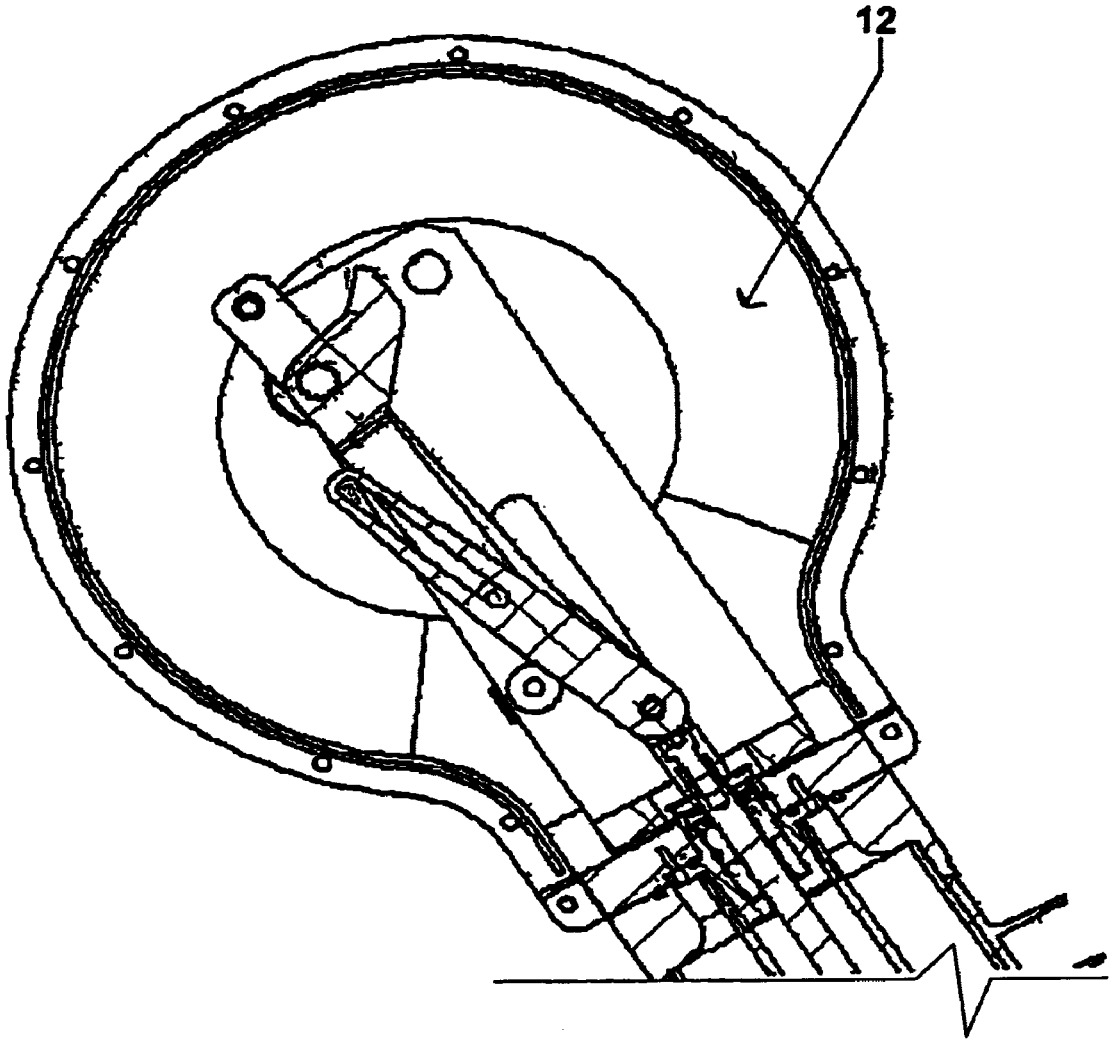
FIG. 9 is a perspective cut-away view of an the toggle mechanism of the internally switched electric power of FIG. 7.
Figure 10:
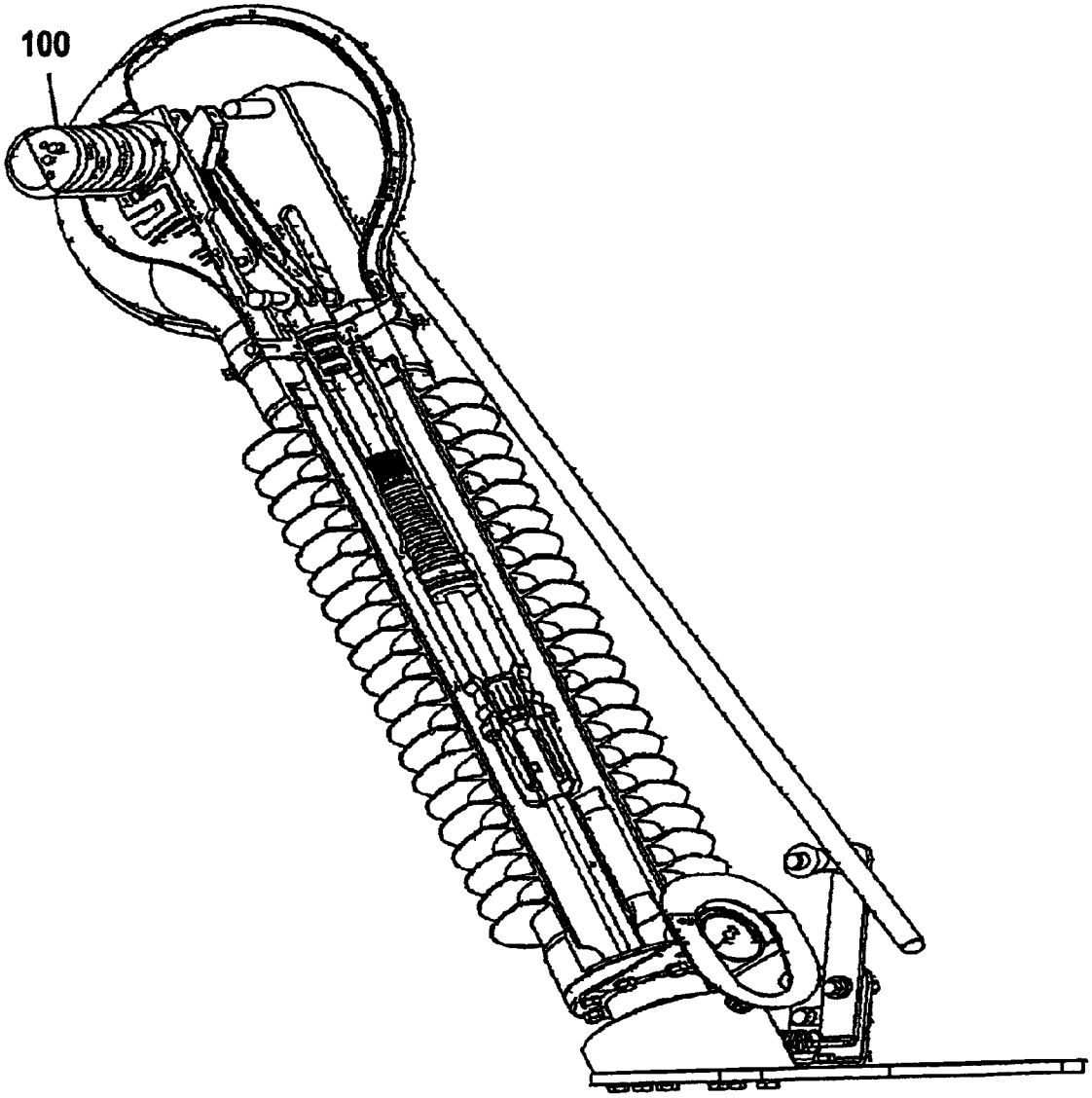
FIG. 10 is a perspective cut-away view of an internally switched electric power interrupter including a spring return mechanism.

FIG. 7 is a perspective cut-away view of the internally switched electric power interrupter 10 including the toggle mechanism 12 in the closed position. This figure shows certain elements not shown on FIGS. 1–6, including the insulator 70, the actuator arm 72, the stationary contact 74 of the internal penetrating contactor, and the weather cover 76 housing the toggle mechanism 12. The tulip-type moving contact 16 of the internal penetrating contactor is also shown more fully than in FIGS. 1–6. FIG. 8 is a cross-sectional side view of the internally switched electric power interrupter 10, and FIG. 9 shows a closer view of the toggle mechanism 12. FIG. 10 shows an alternative embodiment that includes a return spring 100 for resetting the toggle mechanism.

Figure 11:
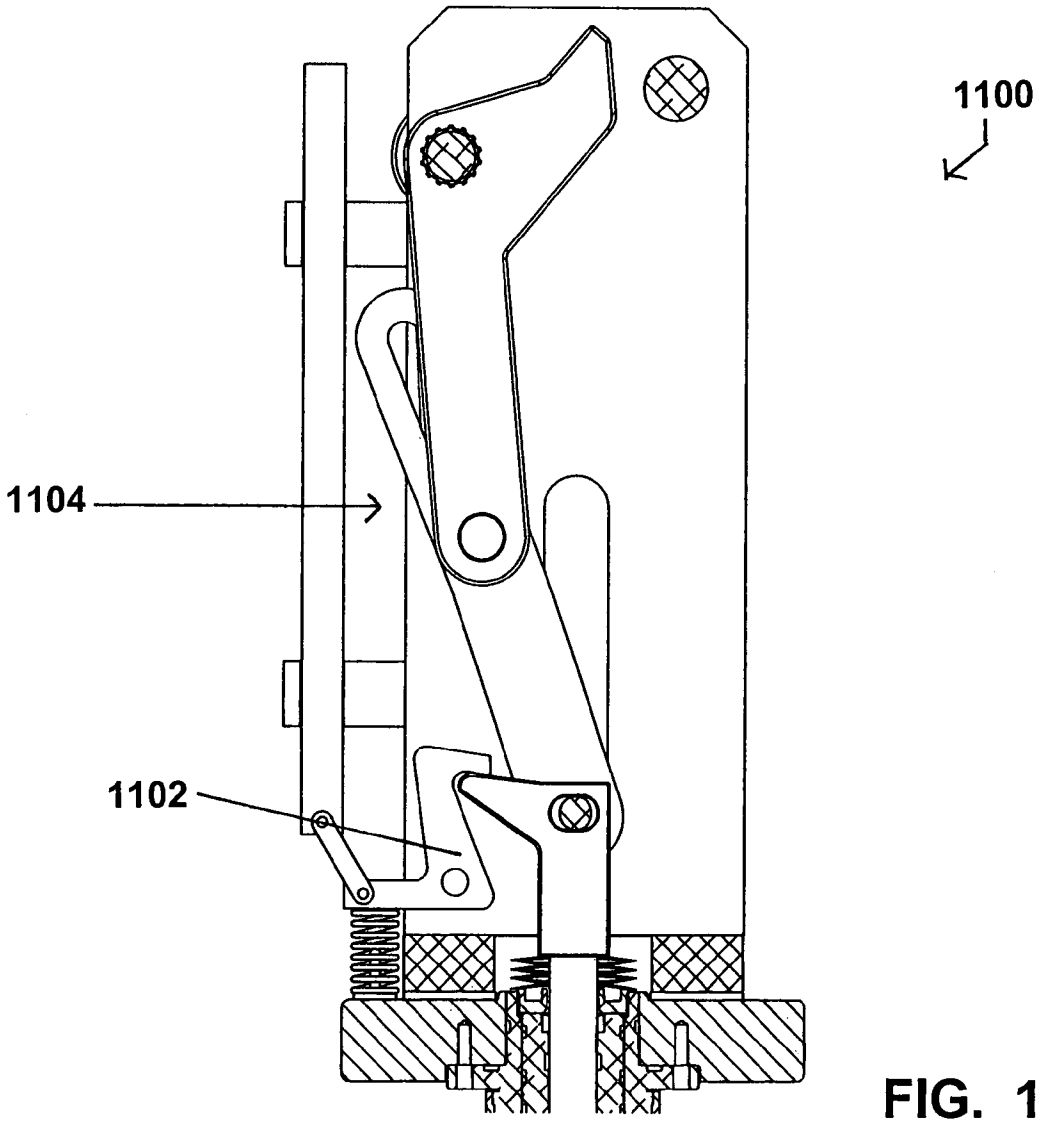
FIG. 11 is a side cross-sectional side view of a latch mechanism with a pawl and slot link in the cocked position.
Figure 12:
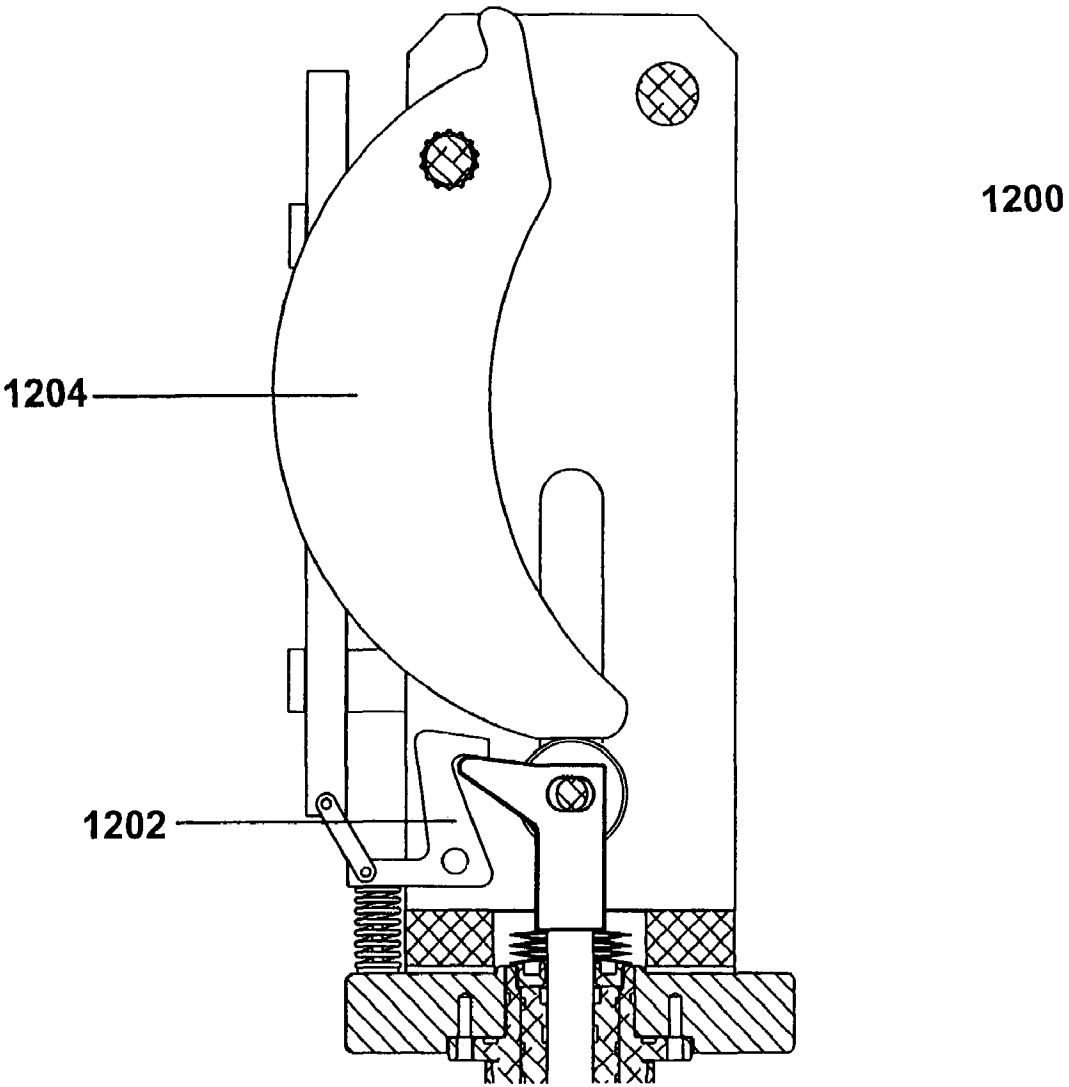
FIG. 12 is a side cross-sectional side view of a latch mechanism with a pawl and cam link in the cocked position.
Figure 13:
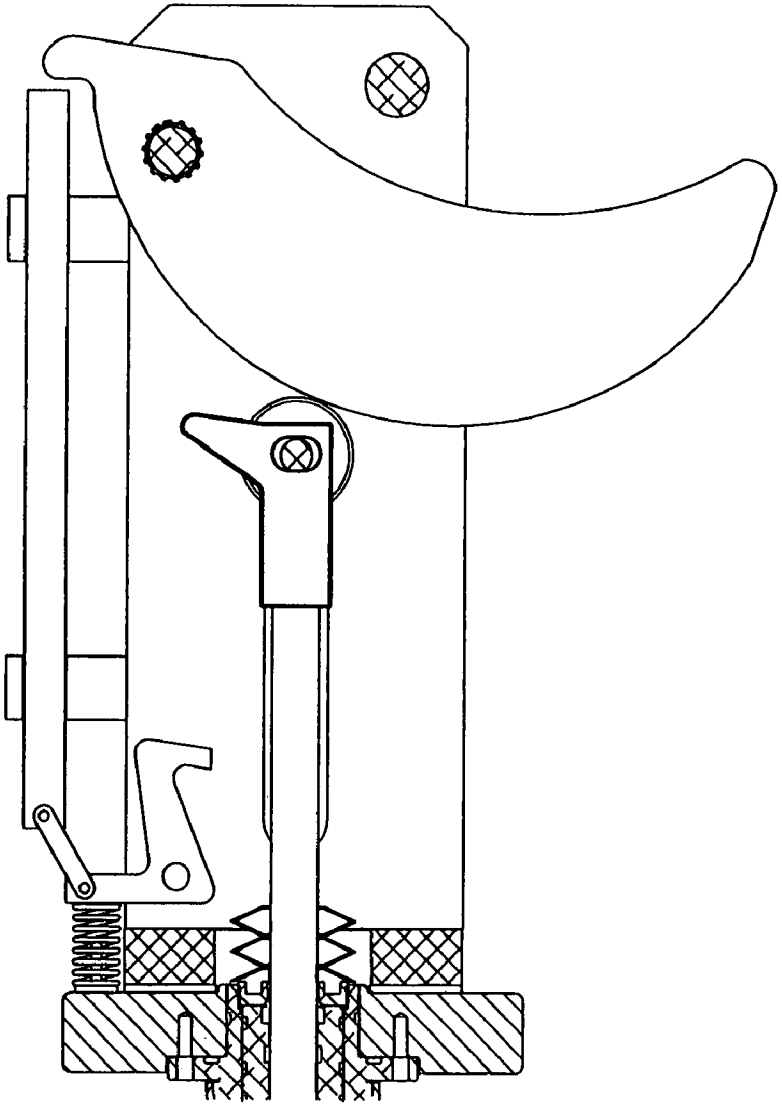
FIG. 13 is a side cross-sectional side of the latch mechanism of FIG. 11 in the released position.

FIG. 11 is a side cross-sectional side view of a latch mechanism 1100 with a spring-loaded pawl 1102 and slot link 1104 in the cocked position. FIG. 12 is a side cross-sectional side view of a latch mechanism 1200 with a pawl 1202 and cam link 1204 in the cocked position. FIG. 13 shows the latch mechanism 1200 in the released position. These latch mechanisms operate in a similar manner to the toggle mechanism 12 described in detail with reference to FIGS. 1–6.

In view of the foregoing, it will be appreciated that present invention provides significant improvements in electric power interrupter switches for electric power distribution, sub-transmission and transmission applications. It should be understood that the foregoing relates only to the exemplary embodiments of the present invention, and that numerous changes may be made therein without departing from the spirit and scope of the invention as defined by the following claims.

The invention claimed is:

1. An internally switched electric power interrupter, comprising:

an insulator having an internal chamber;

a contactor having a movable contact and a stationary contact operable for opening an electric power circuit located within the internal chamber;

a main spring operable for linearly accelerating the movable contact sufficiently to extinguish an arc occurring across a gap between the movable contact and the stationary contact at a designed operational voltage of the electric power circuit;

a latch mechanism that may be maneuvered into a cocked position in which the main spring is maintained in a charged condition, the latch mechanism releasable from the cocked position in response to a trip action to release the movable contact to accelerate under the force of the main spring for opening the electrical circuit; and wherein the latch mechanism includes a toggle mechanism comprising:

a linkage arm pivotally connected to a drive shaft that is in physical communication with the movable contact;

a push link pivotally connected to the drive shaft proximate to a first end of the push link and comprising a first guide element proximate to a second end of the push link;

a trip link pivotably connected to the linkage arm proximate to a first end of the trip link and comprising a trip element proximate to a second end of the trip link;

a main link pivotally connected to the trio link comprising a second guide element at a first end of the main link, and further comprising a trip lever proximate to a second end of the main link; and a stop configured to maintain the toggle mechanism in the cocked position.

2. The internally switched electric power interrupter of claim 1, wherein:

the main link is further configured to rotate under applied force to create the trip action by pushing the trip element to release the toggle mechanism from the cocked position and thereby move the drive shaft to linearly accelerate the movable contact under force applied by the main spring.

3. The internally switched electric power interrupter of claim 2, wherein:

the first guide element comprises a slot;

the second guide element comprises a pin received within the slot;

the trip element comprises a push surface;

the main link comprises a lever; and the stop comprises a stop surface attached to a structure supporting the toggle mechanism.

4. The internally switched electric power interrupter of claim 3, wherein the pin moves within the slot as the drive shaft moves under the force of the main spring.

5. The internally switched electric power interrupter of claim 2, wherein the linkage arm rests against the stop when the toggle mechanism is in the cocked position.

6. The internally switched electric power interrupter of claim 2, wherein the linkage arm and the trip link are almost linear when the toggle mechanism is in the cocked position resulting in a low-force trip action.

7. The internally switched electric power interrupter of claim 2, wherein:

the toggle mechanism is housed within an enclosure adjacent to an end of the internal chamber of the insulator;

the internal chamber contains a dielectric gas; and the drive shaft extends from the enclosure through a seal proximate to the end of the internal chamber and into the internal chamber.

8. The internally switched electric power interrupter of claim 2, wherein the trip action is applied to the latch mechanism through movement of an actuator arm that pivotally drives the main link.

9. The internally switched electric power interrupter of claim 8, wherein a moving disconnect arm of a disconnect switch applies the trip action to the actuator arm by moving the actuator arm from an initial position during an initial portion of an opening stroke of the disconnect arm, thereby triggering the internally switched electric power interrupter to break the electric power circuit across the contactor within the internal chamber of the interrupter to avoid multiple arcing restrikes across a gap between the moving disconnect arm and an associated stationary disconnect contact during the opening stroke of the disconnect arm.

10. The internally switched electric power interrupter of claim 9, wherein gravity returns the actuator arm to the initial position and thereby returns the latch mechanism to the cocked position.

11. The internally switched electric power interrupter of claim 9, wherein the moving disconnect arm returns the actuator arm to the initial position during a closing stroke of the disconnect arm and thereby returns the latch mechanism to the cocked position.

12. The internally switched electric power interrupter of claim 9, further comprising a return spring that returns the actuator arm to the initial position and thereby returns the latch mechanism to the cocked position.

13. The internally switched electric power interrupter of claim 9, wherein the disconnect arm, the stationary disconnect contact, and an insulator supporting the stationary disconnect contact are standard disconnect switch elements that were not modified to accommodate the installation of the internally switched electric power interrupter.

14. The internally switched electric power interrupter of claim 1, wherein the latch mechanism comprises a cam and pawl.

15. The internally switched electric power interrupter of claim 1, wherein the drive shaft comprises a low friction outer surface.

16. The internally switched electric power interrupter of claim 1, further comprising a secondary spring to assist the main spring during an initial portion of the movement of the drive shaft after the release of the toggle mechanism.

17. The Internally switched electric power Interrupter of claim 1, wherein the contactor comprises a probe contact and a socket contact that receives the probe contact.

18. The internally switched electric power interrupter of claim 17, wherein the stationary contact comprises the probe contact and the movable contact comprises the socket contact.

19. The internally switched electric power interrupter of claim 18, wherein the seal comprises a linear shaft seal.

20. The internally switched electric power interrupter of claim 18, wherein the seal comprises a bellows.

21. The internally switched electric power interrupter of claim 20, wherein the bellows seal comprises a secondary spring to assist in acceleration of the movable contactor.

22. An internally switched electric power interrupter, comprising:

an insulator having an internal chamber;

a contactor having a movable contact and a stationary contact operable for opening an electric power circuit located within the internal chamber;

a main spring operable for linearly accelerating the movable contact sufficiently to extinguish an arc occurring across a gap between the movable contact and the stationary contact at a designed operational voltage of the electric power circuit; and a latch mechanism comprising a slot link and pawl that may be maneuvered into a cocked position in which the main spring is maintained in a charged condition, the latch mechanism releasable from the cocked position in response to a trip action to release the movable contact to accelerate under the force of the main spring for opening the electrical circuit.

23. A method for retrofitting a standard disconnect switch having a moving disconnect arm, a stationary disconnect contact, and an insulator supporting the stationary disconnect contact, comprising the steps of:

installing an internally switched electric power interrupter to operate cooperatively with the disconnect switch; and configuring the internally switched electric power interrupter to include an insulator having an internal chamber, a contactor having a movable contact and a stationary contact operable for opening an electric power circuit located within the internal chamber, a main spring operable for linearly accelerating the movable contact sufficiently to extinguish an arc occurring across a gap between the movable contact and the stationary contact at a designed operational voltage of the electric power circuit, and a latch mechanism that may be maneuvered into a cocked position in which the main spring is maintained in a charged condition, the latch mechanism releasable from the cocked position in response to a trip action to release the movable contact to accelerate under the force of the main spring for opening the electrical circuit.

24. The method of claim 23, further comprising the steps of:

configuring the latch mechanism to include a toggle mechanism comprising a linkage arm pivotally connected to a drive shaft that is in physical communication with the movable contact, a push link pivotally connected to the drive shaft proximate to a first end of the push link and comprising a first guide element proximate to a second end of the push link, a trip link pivotally connected to the linkage arm proximate to a first end of the trip link and comprising a trip element proximate to a second end of the trip link, a main link pivotally connected to the trip link comprising a second guide element at a first end of the main link and further comprising a trip lever proximate to a second end of the main link, a stop configured to maintain the toggle mechanism in the cocked position; and configuring the main link to rotate under applied force to create the trip action by pushing the trip element to release the toggle mechanism from the cocked position and thereby move the drive shaft to linearly accelerate the movable contact under force applied by the main spring.

25. The method of claim 24, further comprising the steps of:

configuring the first guide element to include a slot;

configuring the second guide element to include a pin received within the slot;

configuring the trip element to include a push surface;

configuring the main link to include a lever; and configuring the stop to include a stop surface attached to a structure supporting the toggle mechanism.

26. The method of claim 23, further comprising the step of configuring the latch mechanism to include a pawl and slot link.

27. The method of claim 23, further comprising the step of configuring the latch mechanism to include a cam and pawl.

28. The method of claim 23, further comprising the step of installing the internally switched electric power interrupter to operate cooperatively with the disconnect switch without modifying the disconnect arm, the stationary disconnect contact, or the insulator supporting the stationary disconnect contact of the disconnect switch.

* * * * *